US005094196A

United States Patent [19]

Tsurutani et al.

[11] Patent Number: 5,094,196

[45] Date of Patent: Mar. 10, 1992

[54] SYSTEM FOR OPERATING TWO-CYCLE SPARK IGNITION ENGINE

[75] Inventors: Kazushi Tsurutani; Daijiro Hosogai; Kakuro Kokubo, all of Ohi; Touru Yasunobe; Akira Ono, both of Tokyo, all of Japan

[73] Assignees: Tonen Corporation; Mitsui Shipbuilding & Engineering Co., Ltd., both of Tokyo, Japan

[21] Appl. No.: 654,986

[22] Filed: Feb. 14, 1991

[51] Int. Cl.[5] ..... F02M 29/00

[52] U.S. Cl. ..... 123/73 A; 123/73 AD; 123/590; 123/179.9

[58] Field of Search ..... 123/590, 187.5 R, 73 A, 123/73 AD

[56] References Cited

U.S. PATENT DOCUMENTS

| | | | |
|---|---|---|---|
| 3,613,649 | 10/1971 | Moss | 123/452 |
| 4,418,672 | 12/1983 | Muller et al. | 123/478 |
| 4,570,597 | 2/1986 | Snaper | 123/444 |
| 4,576,136 | 3/1986 | Yamauchi et al. | 123/478 |
| 4,632,285 | 12/1986 | Misawa et al. | 123/73 A |
| 4,643,151 | 2/1987 | Yamauchi et al. | 123/509 |
| 4,703,743 | 11/1987 | Takayama | 123/590 |
| 4,846,118 | 7/1989 | Slattery et al. | 123/73 AD |
| 4,984,550 | 1/1991 | Toczyski et al. | 123/590 |
| 4,986,248 | 1/1991 | Kobayashi et al. | 123/590 |
| 5,020,484 | 6/1991 | Ishikawa et al. | 123/73 AD |

*Primary Examiner*—David A. Okonsky

*Attorney, Agent, or Firm*—Armstrong, Nikaido, Marmelstein, Kubovcik & Murray

[57] ABSTRACT

A system for operating a two-cycle spark ignition engine, comprising an ultrasonic atomizer that is disposed in an intake pipe of the spark ignition engine. When the engine is to be started, a fuel for starting is supplied to the ultrasonic atomizer, and after the engine has been started, a gas oil is supplied to the ultrasonic atomizer to atomize and spray it into the intake pipe, thereby enabling an increase in the flow rate of fuel atomized and sprayed by the ultrasonic atomizer and realizing combustion of gas oil, and thus achieving a lowering in the fuel cost, ensuring safety and making it possible to provide a lightweight emergency pump unit which is suitable for use in vessels, for example.

4 Claims, 2 Drawing Sheets

SYSTEM FOR OPERATING TWO-CYCLE SPARK IGNITION ENGINE

BACKGROUND OF THE INVENTION

The present invention relates to an operating system that is applied to an emergency pump unit, which is used as a fire pump or a drain pump in vessels, for example, the system enabling a two-cycle spark ignition engine, which is used to operate such an emergency pump unit, to be operated with gas oil.

A typical conventional emergency pump unit that is used as a fire pump or a drain pump in vessels employs a two-cycle spark ignition engine that uses gasoline as fuel. This is because such a two-cycle spark ignition engine is light in weight and small in size in comparison to other types of engine, for example, diesel engines, and it is therefore suitable for a fire pump from the viewpoint of startability and portability The prior art suffers, however, from the problems that vessels must have gasoline always ready on hand, and the prior art is inferior in safety.

If a two-cycle spark ignition engine is designed to use fuel other than gasoline in order to solve the above-described problems, it will become difficult to start the engine. In Japanese Patent Public Disclosure (Laid-Open) No. 60-62649 (1985), for example, kerosene is used as fuel and supplied in such a way that, only when the engine is to be started, kerosene is atomized by use of an ultrasonic atomizer that comprises a vibrating plate, and when the engine is running in a steady state, the kerosene is supplied through a carburetor. In this system, however, since the ultrasonic atomizer comprises a vibrating plate, the flow rate of atomized fuel is low, so that the ultrasonic atomizer can be used only at the time of starting the engine, and it is impossible to use a gas oil that is heavier than kerosene.

SUMMARY OF THE INVENTION

It is an object of the present invention to provide a system for operating a two-cycle spark ignition engine of an emergency pump unit that is suitable for use in vessels, which enables such a two-cycle spark ignition engine to be operated with gas oil by use of an ultrasonic atomizer, thereby solving the above-described problems of the prior art.

It is another object of the present invention to achieve a stable engine running and reduce the emission of smoke when a gas oil is used in a two-cycle spark ignition engine.

To these ends, the present invention provides a system for operating a two-cycle spark ignition engine, which comprises an ultrasonic atomizer that is disposed in an intake pipe of the spark ignition engine, the ultrasonic atomizer having a cylinder, a fuel passage that is formed in the cylinder, and a vibrating member that is disposed inside the cylinder, wherein, when the engine is to be started, a fuel for starting is supplied to the vibrating member of the ultrasonic atomizer, and after the engine has been started, a gas oil is supplied to the vibrating member of the ultrasonic atomizer, thereby atomizing and spraying the gas oil into the intake pipe.

Examples of fuel for starting are gasoline distillate and other substances which are liquid in an ordinary state and which have a flash point equal to that of gasoline distillate, i.e., highly flammable chemical products, e.g., naphtha, thinner, ether, etc.

The feature of the present invention resides in that the ultrasonic atomizer is disposed in the intake pipe to atomize fuel. However, a carburetor may be employed in addition to the ultrasonic atomizer so that, when the engine is to be started, a fuel for starting is supplied to the carburetor, and after the engine has been started, a gas oil is supplied to the ultrasonic atomizer to atomize and spray it into the intake pipe It is also possible to employ a battery at the time of starting the engine.

According to the present invention, it is possible to increase the amount of fuel atomized and sprayed by the ultrasonic atomizer and improve the combustibility. In consequence, it is possible to realize combustion of gas oil in a two-cycle spark ignition engine and hence possible to reduce the weight, lower the fuel cost and ensure safety. Thus, the present invention provides an emergency pump unit which is particularly suitable for use in vessels.

DESCRIPTION OF THE PREFERRED EMBODIMENTS

Embodiments of the present invention will be described below with reference to the accompanying drawings.

Figure 5:
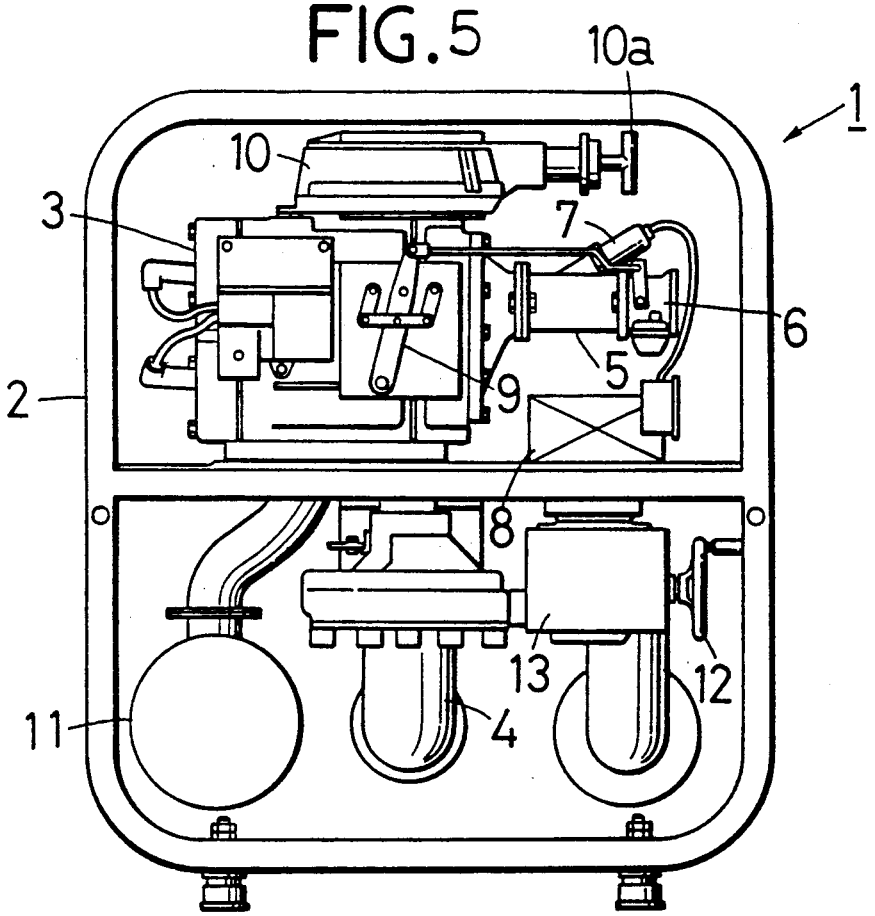
FIG. 5 is a side view of one embodiment of an emergency pump unit to which the present invention is applied.

FIG. 5 shows an emergency pump unit 1 to which the present invention is applied The emergency pump unit 1 comprises a frame 2, a two-cycle spark ignition engine 3 that is secured to the frame 2, and an emergency pump 4 that is also secured to the frame 2. The two-cycle spark ignition engine 3 has an intake pipe 5, a carburetor 6, an ultrasonic atomizer 7, an oscillator 8, a throttle lever 9 with an overrotation preventing mechanism, a recoil type hand starter 10, and a muffler 11 The emergency pump 4 is connected with a vacuum pump 13 which is in turn connected to an output shaft of the two-cycle spark ignition engine 3 through a V-belt.

The emergency pump unit 1 having the above-described arrangement is operated as follows By pulling the handle 10*a* of the recoil type hand starter 10, the two-cycle spark ignition engine 3 is started and the vacuum pump 13 is activated through the V-belt to suck water into the emergency pump 4. Thereafter, the vacuum pump 13 is suspended, and with a handle 12 opened, the throttle lever 9 is operated to fully open the throttle valve, thereby performing a rated load operation.

Figure 1:
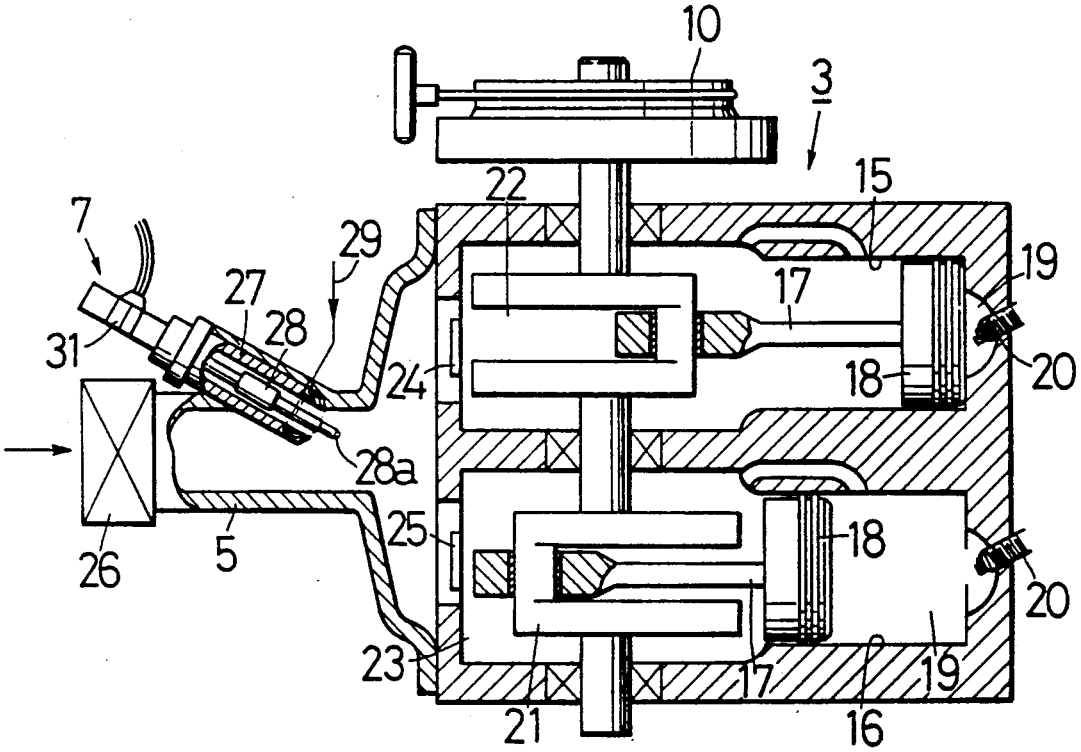
FIG. 1 is a sectional view of one embodiment of a two-cycle spark ignition engine, showing the two-cycle spark ignition engine operating system according to the present invention.

FIG. 1 is a sectional view of one embodiment of the two-cycle spark ignition engine 3. In this embodiment, neither carburetor nor throttle lever is employed.

The two-cycle spark ignition engine 3 has an upper cylinder 15 and a lower cylinder 16, in each of which a piston 18 that is connected to a connecting rod 17 is disposed to define a combustion chamber 19, and an ignition plug 20 is disposed to face the combustion chamber 19. In addition, a crankshaft 21 that enables the connecting rods 17 to perform reciprocating motion is disposed through an upper crankcase 22 and a lower crankcase 23. The upper and lower crankcases 22 and 23 are connected to the intake pipe 5 through respective reed valves 24 and 25. In the intake pipe 5 are disposed the above-described ultrasonic atomizer 7 and an air cleaner 26

The ultrasonic atomizer 7 has a vibrating member 28 that is disposed in a cylinder 27, which is slantingly attached to the intake pipe 5 so that the forward end of the cylinder 27 extends into the intake pipe 5 and faces the reed valves 24 and 25. The distal end portion of the cylinder 27 is formed with an annular fuel passage 30 (see FIG. 2) that is connected to a fuel supply pipe 29. In operation, a signal that is output from the oscillator 8 (see FIG. 5) is converted into ultrasonic vibration in an electroacoustic transducer 31 to atomize the fuel that is supplied to an atomizing portion 28*a* of the vibrating member 28 from the fuel supply pipe 29 through the fuel passage 30, thereby spraying fuel droplets into the intake pipe 5.

The operating system of the embodiment arranged as described above will next be explained. When the two-cycle spark ignition engine 3 is to be started, a small amount of gasoline is supplied to the vibrating member 28 of the ultrasonic atomizer 7 from the fuel supply pipe 29, and the gasoline that is atomized by ultrasonic vibration at the atomizing portion 28*a* is supplied to the combustion chambers 19 through the intake pipe 5, reed valves 24, 25 and the upper and lower crankcases 22 and 23. After the engine has been started, gas oil is supplied to the vibrating member 28 from the fuel supply pipe 29 and atomized by ultrasonic vibration, thereby spraying the atomized gas oil into the intake pipe 5.

Figure 2:
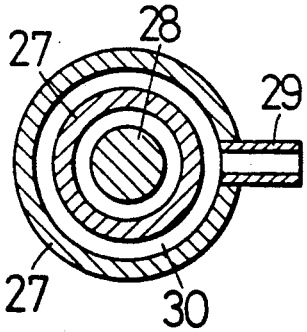
FIG. 2 is a sectional view of the ultrasonic atomizer shown in FIG. 1.
Figure 3:
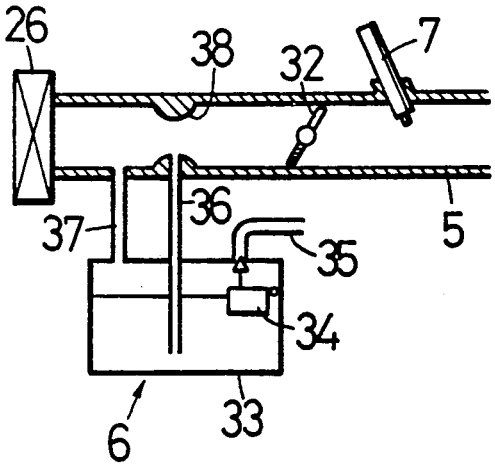
FIG. 3 is a sectional view of a fuel supply section, showing another embodiment of the two-cycle spark ignition engine.

FIG. 3 shows another embodiment of the present invention, in which an air filter 26, a carburetor 6, a throttle valve 32 and an ultrasonic atomizer 7, which is similar to that shown in FIG. 2, are disposed in the intake pipe 5 in the mentioned order from the upstream side, the throttle valve 32 being linked to the throttle lever 9 shown in FIG. 5.

The carburetor 6 comprises a float chamber 33, a float 34, a fuel supply pipe 35, a nozzle pipe 36 and an air bypass pipe 37 for generating a differential pressure. The distal end of the nozzle pipe 36 is opened into a venturi portion 38 that is formed in the intake pipe 5. Through the fuel supply pipe 35, a fuel of excellent ignitionability, e.g., gasoline, is supplied to the float chamber 33. The supply of the fuel is controlled to a predetermined level by means of the float 34 Since the level of negative pressure at the venturi portion 38 increases as the degree of opening of the throttle valve 32 increases, gasoline is sprayed into the intake pipe 5 from the nozzle pipe 36 at a flow rate that is proportional to the level of negative pressure. On the other hand, the ultrasonic atomizer 7 is supplied with a gas oil from a fuel pump (not shown).

A method of supplying fuel to the two-cycle spark ignition engine shown in FIG. 3 will next be explained with reference to FIG. 4.

Figure 4:
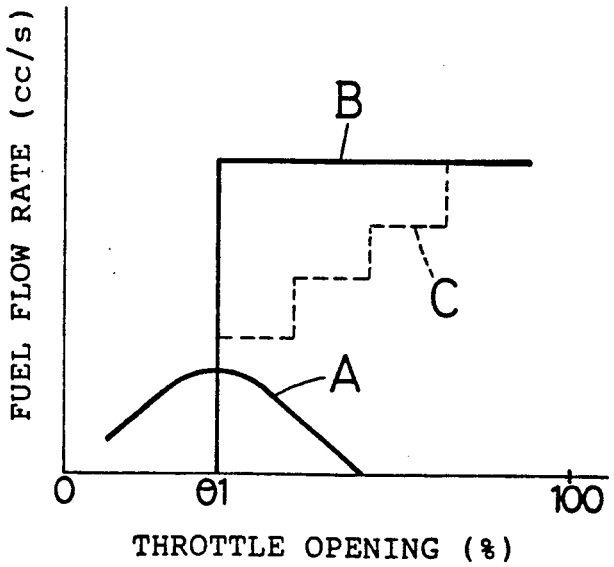
FIG. 4 is a graph showing the relationship between the throttle opening and the flow rate of fuel, for explanation of the fuel supply method in the arrangement shown in FIG. 3.

At the time of starting the engine, while the opening of the throttle valve 32 is small, the supply of a gas oil from the ultrasonic atomizer 7 is stopped, but a fuel of excellent ignitionability, e.g., gasoline, is supplied instead in such a manner that the fuel flow rate increases as the throttle opening increases, as shown by the curve A in FIG. 4. When the throttle opening reaches a predetermined value $\theta 1$ after the engine has been started, the gas oil is supplied from the ultrasonic atomizer 7, as shown by the curve B in the figure, and at the same time, the supply of the gasoline fuel is gradually reduced and eventually suspended. It should be noted that the supply of fuel from the ultrasonic atomizer 7 may be increased stepwisely, as shown by the curve C in the figure. The control of the gasoline fuel is effected by means of a control valve that is provided in the nozzle pipe 36 or the air bypass pipe 37.

Incidentally, spark ignition engines which are supplied with gasoline and a gas oil involve the problem that an engine trouble occurs if fuel is supplied at a flow rate which is necessary for a rated load operation before this state is reached. More specifically, if gas oil is supplied through the carburetor 6 at the time of starting the engine, as the throttle opening increases, an excessive amount of fuel is supplied from the float chamber 33 of the carburetor 6, which invites an engine trouble and an increase in the emission of smoke.

According to the above-described embodiment, a fuel of excellent ignitionability, e.g., gasoline, is supplied from the carburetor 6, and a gas oil from the ultrasonic atomizer 7, so that it is possible to achieve a stable engine running and reduce the emission of smoke.

What is claimed is:

1. A system for operating a two-cycle spark ignition engine, comprising an ultrasonic atomizer that is disposed in an intake pipe of said spark ignition engine, said ultrasonic atomizer having a cylinder, a fuel passage that is formed in said cylinder, and a vibrating member that is disposed inside said cylinder, wherein, when said engine is to be started, a fuel for starting is supplied to said vibrating member of said ultrasonic atomizer, and after said engine has been started, a gas oil is supplied to said vibrating member of said ultrasonic atomizer, thereby atomizing and spraying the gas oil into said intake pipe.

2. A system for operating a two-cycle spark ignition engine, comprising an ultrasonic atomizer and a carburetor that are disposed in an intake pipe of said spark ignition engine, said ultrasonic atomizer having a cylinder, a fuel passage that is formed in said cylinder, and a vibrating member that is disposed inside said cylinder, wherein, when said engine is to be started, a fuel for starting is supplied into said intake pipe from said carburetor, and after said engine has been started, a gas oil is supplied to said vibrating member of said ultrasonic atomizer, thereby atomizing and spraying the gas oil into said intake pipe.

3. A system for operating a two-cycle spark ignition engine, comprising an ultrasonic atomizer, a throttle valve and a carburetor, which are disposed in an intake pipe of said spark ignition engine, said ultrasonic atomizer having a cylinder, a fuel passage that is formed in said cylinder, and a vibrating member that is disposed inside said cylinder, wherein, at the time of starting said engine, while the degree of opening of said throttle valve is small, a fuel for starting is supplied into said intake pipe from said carburetor, and as the throttle valve opening increases, the flow rate of a gas oil that is supplied to said vibrating member of said ultrasonic atomizer is increased, thereby atomizing and spraying the gas oil into said intake pipe.

4. A system for operating an emergency pump unit that is mounted on vessels by the two-cycle spark ignition engine of any one of claims 1, 2 or 3.

* * * * *